US008803109B1

(12) United States Patent
Mcpherson

(10) Patent No.: US 8,803,109 B1
(45) Date of Patent: Aug. 12, 2014

(54) ENERGY EFFICIENT MULTI-SPECTRUM SCREEN EXPOSURE SYSTEM

(71) Applicant: Shawn Crawford Mcpherson, Minneapolis, MN (US)

(72) Inventor: Shawn Crawford Mcpherson, Minneapolis, MN (US)

( * ) Notice: Subject to any disclaimer, the term of this patent is extended or adjusted under 35 U.S.C. 154(b) by 0 days.

(21) Appl. No.: 13/843,198

(22) Filed: Mar. 15, 2013

(51) Int. Cl.
*G03C 5/16* (2006.01)

(52) U.S. Cl.
CPC ..... *G03C 5/16* (2013.01)
USPC ..... 250/492.1; 355/27; 355/28; 430/21

(58) Field of Classification Search
USPC ..... 250/492.1; 355/27, 28; 430/21
See application file for complete search history.

(56) References Cited

U.S. PATENT DOCUMENTS 6,278,510 B1 * 8/2001 Stoebe et al. ..... 355/27

OTHER PUBLICATIONS

Takach Press Corporation, "Nu-Arc/AmerGraph Exposure Units" printout, prior to Mar. 15, 2013 (downloaded Jun. 19, 2013), 10 pages.

* cited by examiner

*Primary Examiner* — Kiet T Nguyen
(74) *Attorney, Agent, or Firm* — Patterson Thuente Pedersen, P.A.

(57) ABSTRACT

A multi-spectrum screen exposure system for curing printing emulsions, including an enclosure with a platen that is transmissive to at least some ultraviolet wavelengths of light, a cover shiftable between an open orientation wherein the platen is accessible to an operator and a closed orientation wherein the platen is covered and inaccessible to the operator, a light emitting diode illumination (LED) light source assembly supported within the enclosure and oriented to direct illumination toward the platen, the light emitting diode illumination light source assembly emitting at least some light in the ultraviolet wavelengths, and a control unit operably coupled to the light emitting diode illumination light source assembly by which the light emitting diode illumination light source assembly can be operated in a controlled fashion.

16 Claims, 7 Drawing Sheets

ENERGY EFFICIENT MULTI-SPECTRUM SCREEN EXPOSURE SYSTEM

FIELD OF THE INVENTION

The invention generally relates to imaging screen printing and flexographic printing. More particularly, the invention relates to curing of emulsions on screens and other printing related products by exposure to particular wavelengths of electromagnetic radiation.

BACKGROUND OF THE INVENTION

In the printing industry, a variety of screens and masks and other materials are created by applying a material to a substrate in a desired pattern and then exposing the material and the substrate to ultraviolet light radiation to cross-link the polymers in the material and thereby cure the material and secure it to the substrate. For the purposes of this application, the example of screens for silk screening and screen printing processes will be used. But, it is to be understood that the curing processes disclosed herein can be applied to many other printing industry curing needs.

According to common practice in the industry, various exposure systems are used. An exposure system generally includes an enclosure, a transparent, transmissive or translucent platen and an opaque cover which also often includes a device for securing the screen to the platen during exposure process. The enclosure includes a source of electromagnetic radiation that produces electromagnetic radiation of the desired wavelength. Commonly, electromagnetic radiation is used in the ultraviolet wavelengths. Commonly, illumination of these systems is provided by high intensity lamps such as metal halide lamps. Metal halide lamps produce a broad light spectrum including the ultraviolet spectrum. Besides the useful ultraviolet spectrum, metal halide lamps also produce a great deal of waste light, the waste light being the portion of the broad light spectrum that is not useful in the exposure process. This waste light represents a substantial waste of energy. It is not uncommon for screen light exposure systems to draw amounts of energy up to 6 kW. Generally because of their high power draw requirements metal halide lamp systems must be coupled to a 220 volt circuit to accommodate their power needs.

In addition, metal halide lamps produce large amounts of waste heat which must be dissipated. Accordingly, the systems often have complicated cooling systems. Some systems are cooled by cooling fans which must be continuously monitored to control lamp temperature and to prevent excess heat exposure from damaging the emulsion screens and substrates. To prevent excess heat exposure, some systems use water cooling arrangements in order to dissipate the great amount of excess heat produced.

Another issue is that lamps of the prior art, such as metal halide lamps, gradually change their emission qualities over time. Thus, in order to operate and provide accurate exposures, these systems often require computerized programmable exposure control systems to compensate for variations in lamp emission and energy output. Often these exposure control systems are relatively complicated in order to maintain a level of ultraviolet lighting exposure in the desired wavelengths to properly cure emulsions.

In addition, high intensity metal halide or mercury lamps typically have a given period of time during which the lamp is warming up or coming up to temperature. During this warm up period the light spectrum produced is relatively unpredictable, thus causing variations in the amount of light exposure to the emulsion over time.

In addition, metal halide lamps and the other lamps commonly used have a limited use of life, typical lamp life spans range from tens to hundreds of hours. Accordingly, metal halide lamps or other lamps must be replaced on a regular basis. These lamps are relatively expensive and their replacements must be budgeted for.

Another issue is that metal halide lamps and other lamps used in the exposure process often include hazardous waste in the form of heavy metals, such as lead and mercury, and require proper disposal to prevent releasing these heavy metals and other toxins into the environment. Mercury lamps in particular are a problem for disposal.

Accordingly, there is room for improvement in printing industry screen exposure systems. What is needed is a screen exposure system which is less wasteful of energy, does not require specialized electrical circuitry and power requirements to operate, does not produce large amounts of excess heat, does not require large and cumbersome computerized programmable exposure control systems to control, does not have extensive warm up periods with an unpredictable spectrum output, has lamps with relatively long life spans, and does not pose a hazardous waste threat to the environment when disposed of

SUMMARY OF THE INVENTION

The present invention addresses these problems by providing embodiments of a multi-spectrum screen exposures system for curing printing emulsions. Specifically, the illumination system of the present invention produces less heat and thus requires less cooling than systems of the prior art. Consequently the present invention provides an energy savings of 70-90% over the prior art. Additionally, the present invention provides more accurate exposure times for emulsions because the illumination system of the present invention reaches a full illumination level in approximately 0.005 seconds. The present invention utilizes an illumination system with an illumination life of approximately 50,000 hours. Further, the illumination system of the invention demonstrates no loss of spectral output over the course of its life. Unlike the lamp systems of the prior art, the present invention includes no hazardous waste.

The multi-spectrum screen exposure system for curing printing emulsions of the present invention generally includes an enclosure, a cover, a light emitting diode (LED) illumination light source assembly, and a control unit. The enclosure includes a platen that is transparent, transmissive or translucent to at least some ultraviolet wavelengths of light. The cover is operably coupled to the enclosure and shiftable between an open orientation wherein the platen is accessible to an operator and a closed orientation wherein the platen is covered and inaccessible to the operator. The LED illumination light source assembly is supported within the enclosure and oriented to direct illumination toward the platen. The LED illumination light source assembly emits at least some light in the ultraviolet wavelengths. The control unit is operably coupled to the LED illumination light source assembly by which the LED illumination light source assembly can be operated in a controlled fashion.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The invention can be more completely understood in consideration of the following detailed description of various embodiments of the invention, in connection with the accompanying drawings, in which.

Figure 1:
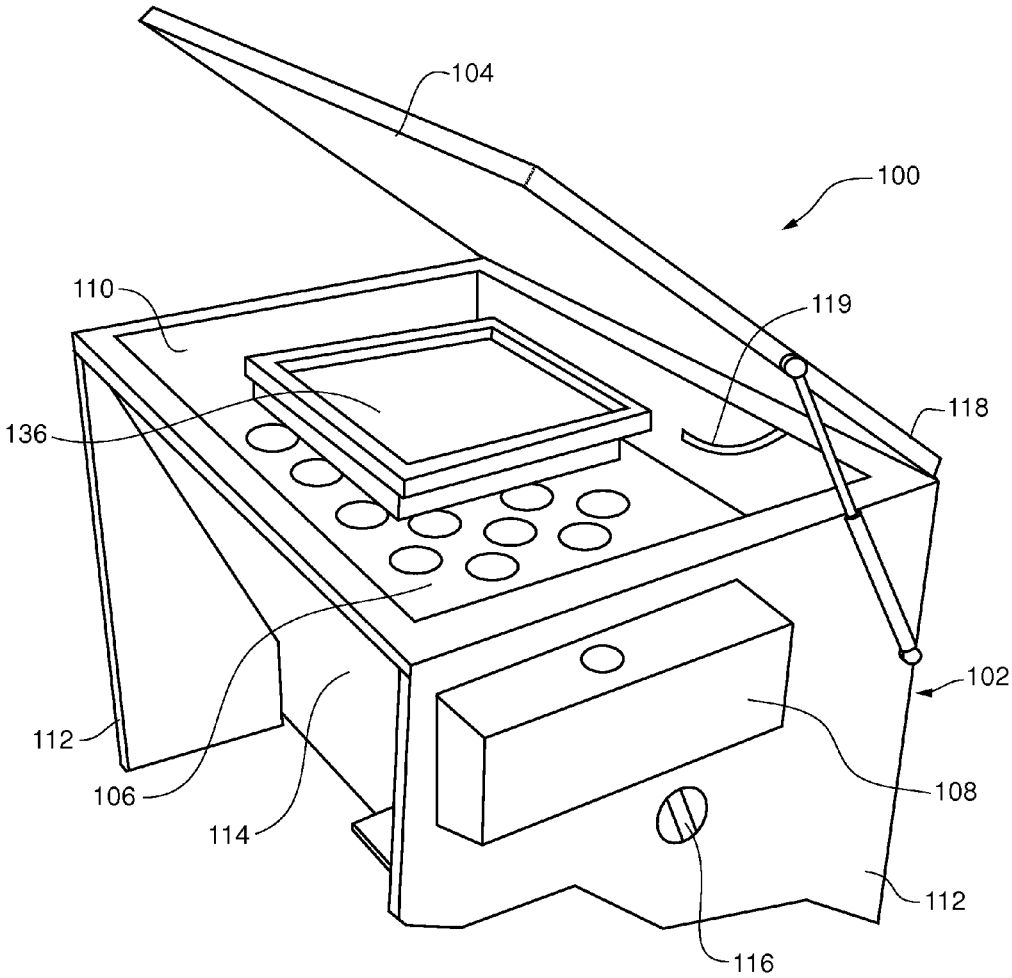
FIG. 1 is a perspective view of a multi-spectrum screen exposure system according to an example embodiment of the invention.
Figure 2:
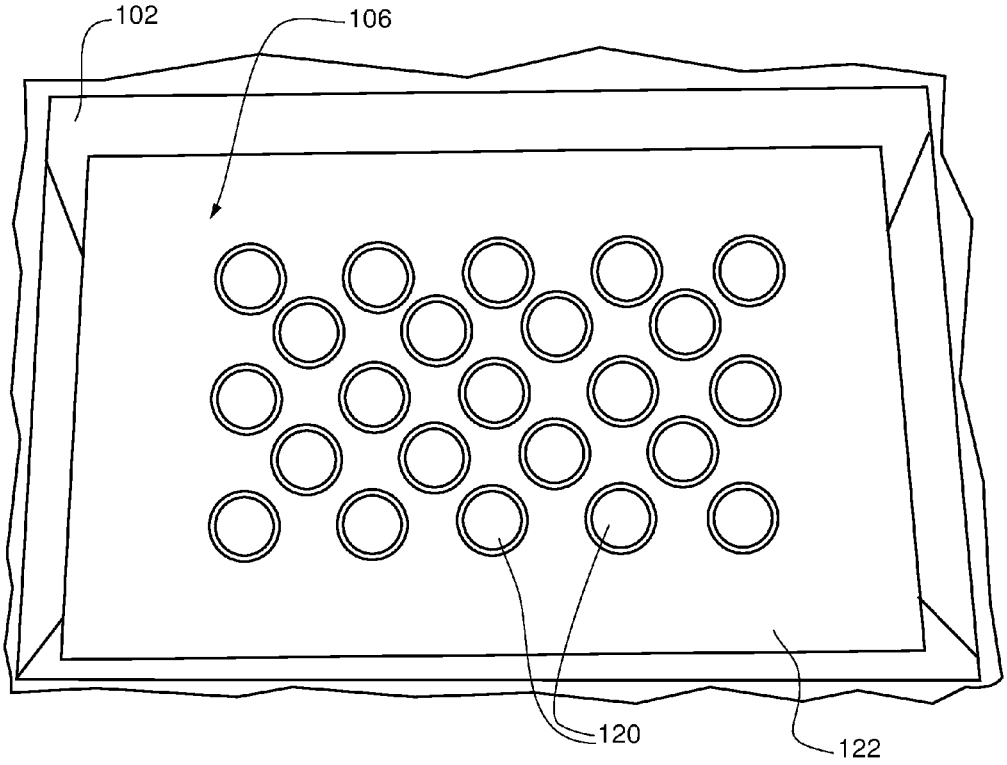
FIG. 2 is a perspective view of an LED illumination light source assembly according to an example embodiment of the invention.
Figure 3:
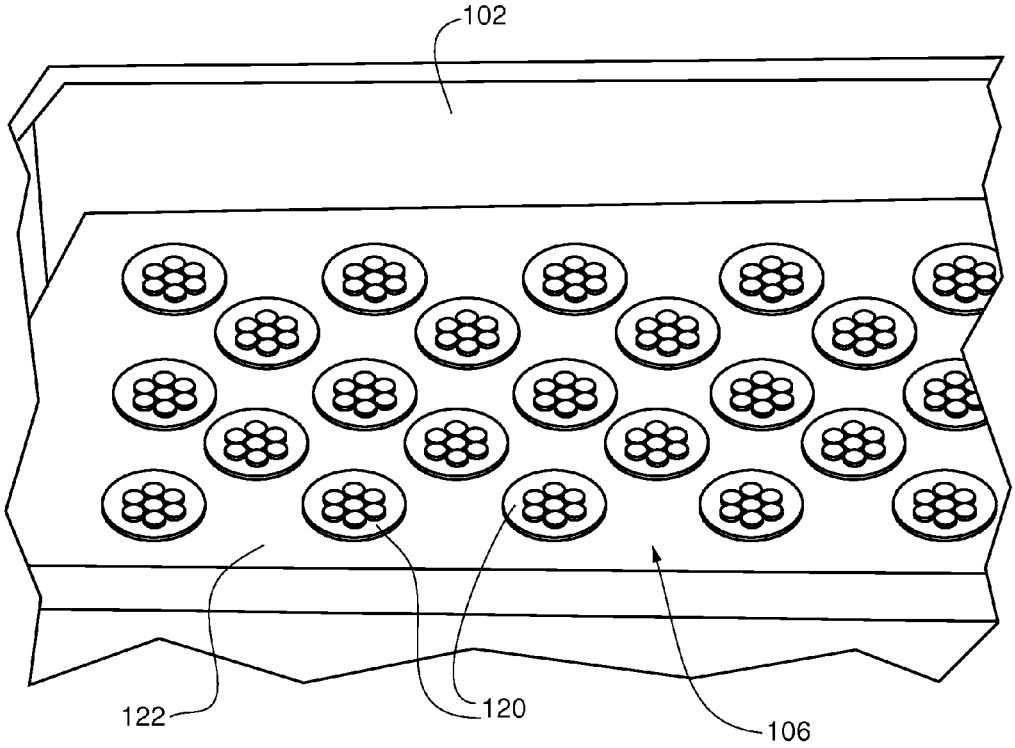
FIG. 3 is another perspective view of the LED illumination light source assembly of FIG. 2.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring now to the drawings and illustrative embodiments depicted therein, a multi-spectrum screen exposure system 100 generally includes an enclosure 102, a cover 104, a light emitting diode (LED) illumination light source assembly 106, and a control unit 108.

As best seen in FIG. 1, enclosure 102 includes a platen 110 on which materials to be irradiated are placed. Platen 110 according to an example embodiment of the present invention is a flat supporting surface made of glass or polymer material, and is at least transparent, transmissive or translucent to some ultraviolet wavelengths of light. In particular, platen 110 is transparent, transmissive or translucent to the particular wavelengths of electromagnetic radiation necessary to cross-link the polymers in the material to be irradiated, for example, in curing emulsions on screens and other substrates. The platen according to the present invention is generally conventional in this regard and need not be further described here.

In an example embodiment, enclosure 102 generally includes supporting legs 112, a light unit enclosure 114, and optionally a cooling fan 116. The supporting legs 112 support the light unit enclosure 114 at a convenient height so that the platen 110 is available at a roughly countertop height for the placement of substrates including emulsions. As discussed above, the LED illumination light source 106 of the present invention produces far less waste heat than the prior art illumination systems, but optionally the multi-spectrum screen exposure system 100 can include a cooling fan 116. In an example embodiment, enclosure 102 can include a rack to hold printing screens 136 or other materials used in conjunction with curing printing emulsions.

Cover 104 is operably coupled to enclosure 102. In an example embodiment, cover 104 can be hingedly attached to enclosure 102, for example by one or more hinges. Relative to enclosure 102, cover 104 is shiftable between an open orientation, wherein platen 110 is accessible to an operator, and a closed orientation, wherein platen 110 is covered by cover 104 and inaccessible to an operator. Cover 104 can have one or more clamps for connecting cover 104 to enclosure 102 when in the closed orientation for the purpose of providing a tighter seal between cover 104 and enclosure 102 when in the closed orientation.

Cover 104 is generally opaque to the particular wavelengths of electromagnetic radiation utilized to cross-link the polymers for the purpose of protecting operators from undesirable exposure of to the electromagnetic radiation. Optionally, cover 104 can include a vacuum holding system 118 or other holding systems, thereby creating a vacuum between cover 104 and platen 110 for the purpose of immobilizing the material to be irradiated against platen 110. Vacuum holding system 118 can include a vacuum hose 119. To aid in the immobilization of the material, cover 104 can be constructed of a flexible material so that when a vacuum is created between the cover 104 and platen 110, cover 104 can temporarily deform to hold the material in place and substantially flat against platen 110. Other aspects of the vacuum holding systems 118 or other holding systems are generally conventional and well-known in the art and will not be further described here.

LED illumination light source assembly 106 is supported within enclosure 102. In an example embodiment, LED illumination light source assembly 106 can be housed in the light unit enclosure 114 of enclosure 102.

LED illumination light source assembly 106 is oriented to direct illumination toward platen 110. When activated the LED illumination light source assembly 106 emits at least some light in the ultraviolet wavelengths. Thus, when the LED illumination light source assembly 106 is activated, a least a portion of the ultraviolet wavelengths emitted by the LED illumination light source assembly 106 pass through the transparent, transmissive or translucent platen 110. In an example embodiment, LED illumination light source assembly 106 can be spaced at a distance wherein light emitted from the LED illumination light source assembly 106 evenly covers the platen 110. In another example embodiment, LED illumination light source assembly 106 can be spaced in a range from 5 inches to 9 inches from, and generally parallel, to platen. 110. In yet another example embodiment, LED illumination light source assembly 106 can be spaced approximately 7 inches from platen 110. Such spacing allows substantially even distribution of the ultraviolet wavelengths through platen 110 to provide greater cross-linking of polymers in the material to be irradiated. Additionally, such spacing allows what heat is generated by LED illumination light source assembly 106 to be dissipated.

Figure 4:
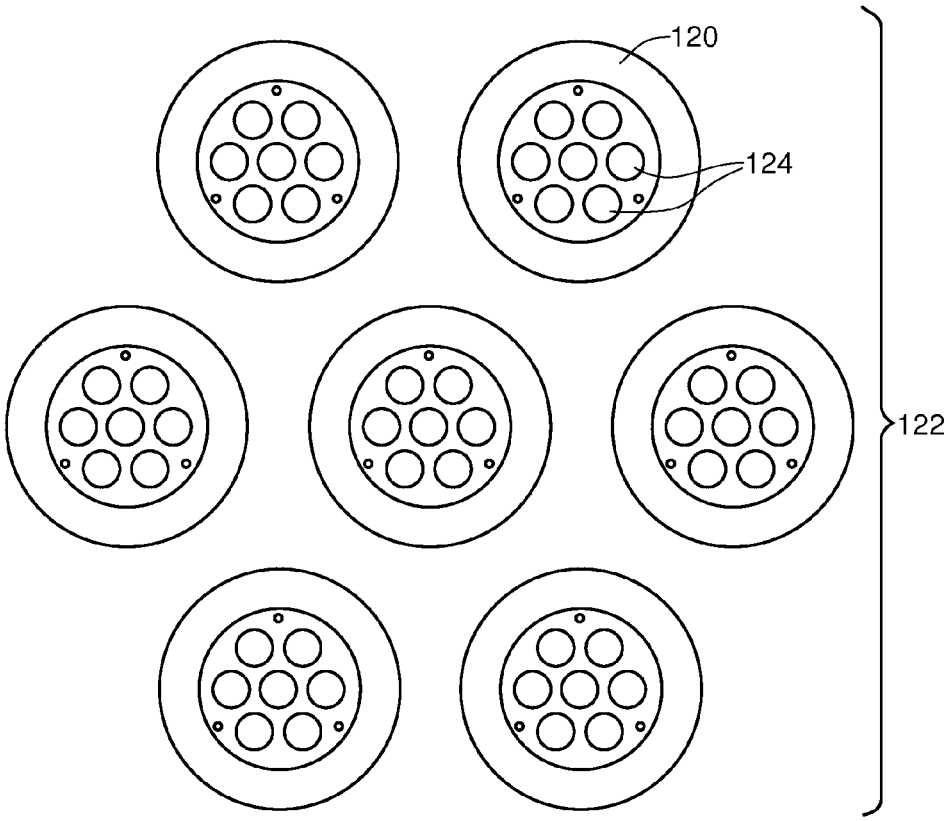
FIG. 4 is a schematic plan view of an LED lamp support array according to an example embodiment of the invention.

In an example embodiment, LED illumination light source assembly 106 can include a plurality of LED lamps 120 supported in a lamp support array 122. In another example embodiment, any number of LED lamps 120 can be arranged in a geometrically regular fashion. In yet another example embodiment, as best seen in FIG. 4, LED lamps 120 can be arranged in a generally hexagonal array.

With the generally hexagonal array pattern, in an example embodiment, the spacing between LED lamps 120 can be in a range from 2.75 inches to 6.75 inches. In another example embodiment, the spacing between LED lamps 120 can be approximately 4.75 inches. The generally hexagonal array pattern and distance between LED lamps 120 is selected to provide substantially even distribution of the light through platen 110 for the purpose of providing more even cross-linking of polymers in the material to be irradiated.

In an example embodiment, each LED lamp 120 can be comprised of a plurality of LEDs 124. The plurality LEDs 124 can emit ultraviolet light in multiple wavelengths. According to an example embodiment of the invention, the total range of LED wavelengths can be in a range from 365 to 420 nm.

Figure 5:
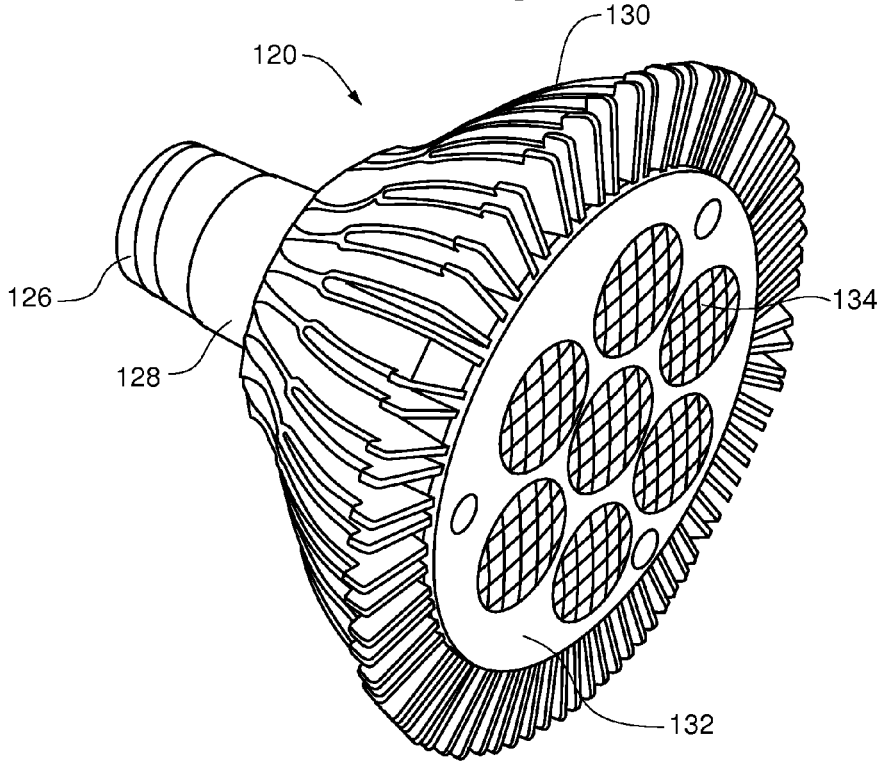
FIG. 5 is a perspective view of an LED lamp according to an example embodiment of the invention.

According to an example embodiment, as best seen in FIG. 5, each LED lamp 120 can include an electrical plug 126, a body 128, a heat sink 130, and an LED array 132. Electrical plug 126 can be sized to fit in a standard sized light socket. Body 126 can be constructed of plastic and can couple electrical plug 126 to heat sink 130. Heat sink 130 can be constructed of a thermally conductive material, such as aluminum. Heat sink 130 can include a plurality of fins for the purpose of dissipating what heat is generated by LEDs 124. LED array 132 can be coupled to either body 128, heat sink 130, or both. LED array 132 can house a plurality of LEDs 124. In an example embodiment, the LEDs 124 can be 1.0625 inches from the outer edge of heat sink 130, as measured from the center of each LED 124. Each individual LED 124 can be accompanied by a 60 degree wide angle lens or diffuser 134 which disperses the light of the LEDs at approximately a 60 degree angle.

Figure 6:
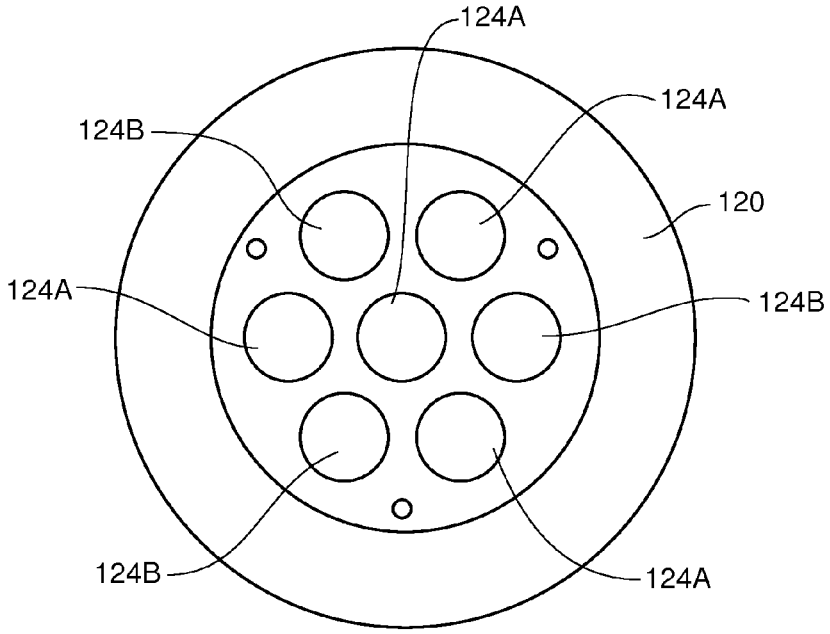
FIG. 6 is a schematic plan view of an LED lamp including seven LEDs according to an example embodiment of the invention.
Figure 7:
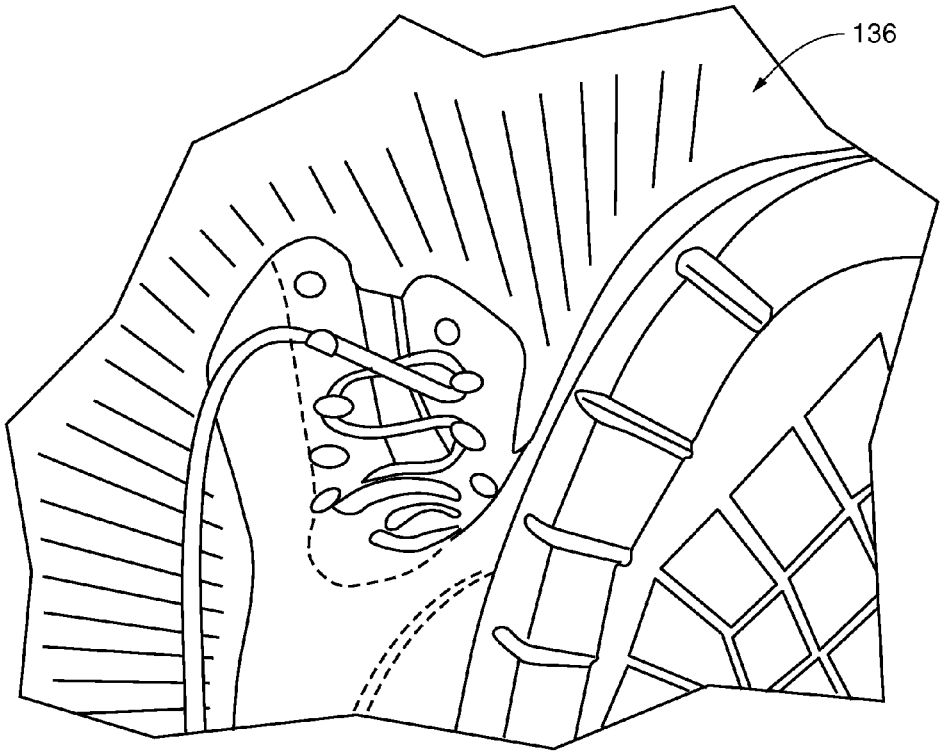
FIG. 7 is a depiction of a printing screen that the invention is utilized to cure.

In an example embodiment, as best seen in FIG. 6, each LED lamp 120 can include seven LEDs 124, wherein six LEDs 124 are substantially equally spaced circumferentially around a single central LED 124. According to an example embodiment, each LED 124 can be spaced 0.75 inches apart, as measured from the center of each LED 124. According to an example embodiment, each LED 124 can be 1 W and each LED lamp 120 can be 7 W.

According to an example embodiment, the LED lamp 120 can include a first portion of the LEDs 124 emitting a first wavelength and a second portion of the LEDs 124 emitting a second wavelength. According to an example embodiment, the LED lamp 120 can include four LEDs 124A emitting light at approximately 420 nm and three LEDs 124B emitting light at approximately 395 nm. According to an example embodiment, the 420 nm LEDs 124A are located centrally and at 120 degree increments surrounding the central 420 nm LED 124A. According to this example embodiment, the wavelength range of the 420 nm LEDs 124A can range from approximately 420 to 430 nm. According to this example embodiment, the 39 nm LEDs 124B are located at 120 degree increments surrounding the central 420 nm LED 124A with each 395 nm LED 124B being alternated with a 420 nm LED 124A. According to this example embodiment, the wavelength range of the 395 nm LEDs 124B can range from approximately 395 to 405 nm.

The control unit 108 of multi-screen exposure system 100 is operably coupled to LED illumination light source assembly 106 by which the LED illumination light source assembly can be operated in a controlled fashion. According to an example embodiment, control unit 108 includes an on/off switch which can be coupled to an accurate timer including a mechanical timer or an electronic timer that controls the on/off cycle of LED lamps 120. Accordingly, control unit 108 is much simpler than those in the prior art.

Control unit 108 can also include cooling controls such as a thermister for sensing temperature within the unit to actuate a cooling fan if needed. However, because the LED illumination light source assembly 106 of the present invention produces much less heat than the prior art, the cooling system can be much simpler and draw much less power than cooling systems of the prior art. For example, the cooling system of the present invention can be comprised of one or two muffin fans, as opposed to the elaborate air or water cooling systems of the prior art.

In operation, an operator of the present invention can use the multi-spectrum screen exposure system 100 to cure printing emulsions on printing screens 136 and other printing related products by exposing the printing emulsions to particular wavelengths of electromagnetic radiation generated by the multi-spectrum screen exposure system 100. The method of curing a printing emulsion can include placing a printing emulsion on a platen of a multi-spectrum screen exposure system and exposing the printing emulsion to ultraviolet wavelengths of light.

In another example of operation, the operator can ensure that cover 104 is positioned in an open orientation wherein the platen is accessible to the operator. The operator can place emulsion materials on platen 110. Optionally, the operator can place a vacuum hose 119 on or proximate to the emulsion materials. Cover 104 can be positioned in a closed orientation wherein the platen 110 is covered by cover 104 and is inaccessible to the operator. Optionally, operator can latch cover 104 to enclosure 102 to create a tight seal between cover 104 and the top of enclosure 102. Optionally, the operator can actuate a vacuum holding system 118. Optionally, the operator can set a timer of the control unit 108. The operator can position the on/off switch to the on position, thereby actuating the LED illumination light source. After a duration of time, operator can position the on/off switch to the off position, and if the vacuum holding system 118 was used, deactivate the vacuum holding system 118. The operator can position the cover 104 in an open orientation (including releasing any latches if used), and remove the cured emulsion materials from platen 110.

What is claimed is:

1. A multi-spectrum screen exposure system for curing printing emulsions, comprising:

an enclosure including a platen that is transmissive to at least some ultraviolet wavelengths of light;

a cover operably coupled to the enclosure and shiftable between an open orientation wherein the platen is accessible to an operator and a closed orientation wherein the platen is covered and inaccessible to the operator;

a light emitting diode illumination light source assembly supported within the enclosure and oriented to direct illumination toward the platen, the light emitting diode illumination light source assembly emitting at least some light in the ultraviolet wavelengths; and a control unit operably coupled to the light emitting diode illumination light source assembly by which the light emitting diode illumination light source assembly can be operated in a controlled fashion.

2. The multi-spectrum screen exposure system, as claimed in claim 1, wherein the light emitted from the light emitting diode illumination light source assembly is diffused.

3. The multi-spectrum screen exposure system, as claimed in claim 1, wherein the light emitting diode illumination light source assembly is spaced at a distance from the platen wherein light emitted from the light emitting diode illumination light source assembly evenly covers the platen.

4. The multi-spectrum screen exposure system, as claimed in claim 1, wherein the light emitting diode illumination light source assembly is spaced in a range from 5 inches to 9 inches from the platen.

5. The multi-spectrum screen exposure system, as claimed in claim 4, wherein the light emitting diode illumination light source assembly is spaced approximately 7 inches from the platen.

6. The multi-spectrum screen exposure system, as claimed in claim 1, wherein the total wavelength of the light emitting diode illumination light source assembly is in a range from 365 nm to 420 nm.

7. The multi-spectrum screen exposure system, as claimed in claim 1, wherein the light emitting diode illumination light source assembly comprises an array of light emitting diode lamps.

8. The multi-spectrum screen exposure system, as claimed in claim 7, wherein the array of light emitting diode lamps is arranged in a geometrically regular fashion.

9. The multi-spectrum screen exposure system, as claimed in claim 8, wherein the array of light emitting diode lamps is arranged in a hexagon.

10. The multi-spectrum screen exposure system, as claimed in claim 9, wherein spacing between light emitting diode lamps is in a range from 2.75 inches to 6.75 inches.

11. The multi-spectrum screen exposure system, as claimed in claim 10, wherein spacing between light emitting diode lamps is approximately 4.75 inches.

12. The multi-spectrum screen exposure system, as claimed in claim 7, wherein each light emitting diode lamp comprises a plurality of light emitting diodes, wherein a first portion of the plurality of light emitting diodes emit ultraviolet light in a first wavelength and a second portion of the plurality of light emitting diodes emit ultraviolet light in a second wavelength.

13. The multi-spectrum screen exposure system, as claimed in claim 12, wherein the first wavelength is in a range from 420 nm to 430 nm and the second wavelength is in a range from 395 nm to 405 nm.

14. The multi-spectrum screen exposure system, as claimed in claim 12, wherein the first wavelength is approximately 420 nm and the second wavelength approximately 395 nm.

15. The multi-spectrum screen exposure system, as claimed in claim 12, wherein the plurality of light emitting diodes is comprised of six light emitting diodes substantially equally spaced circumferentially around a single central light emitting diode.

16. A method of curing a printing emulsion, comprising:

placing a printing emulsion on a platen of a multi-spectrum screen exposure system, wherein the platen is transmissive to at least some ultraviolet wavelengths of light;

exposing the printing emulsion to ultraviolet wavelengths of light, wherein the ultraviolet wavelengths of light are emitted from a plurality of light emitting diodes supported by the multi-spectrum screen exposure system and oriented to direct at least some ultraviolet wavelengths through the platen.

* * * * *